US009958151B2

(12) United States Patent
Park et al.

(10) Patent No.: US 9,958,151 B2
(45) Date of Patent: May 1, 2018

(54) STEAM GENERATOR

(71) Applicant: CONWAY CO., LTD., Gongju-si (KR)

(72) Inventors: Jin Won Park, Seoul (KR); Sang Yoon Park, Seoul (KR); Hyo Sung Kim, Seoul (KR); Chan Jung Park, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 357 days.

(21) Appl. No.: 14/649,886

(22) PCT Filed: Dec. 5, 2013

(86) PCT No.: PCT/KR2013/011224
§ 371 (c)(1),
(2) Date: Jun. 4, 2015

(87) PCT Pub. No.: WO2014/088345
PCT Pub. Date: Jun. 12, 2014

(65) Prior Publication Data

US 2015/0316252 A1 Nov. 5, 2015

(30) Foreign Application Priority Data

Dec. 5, 2012 (KR) ..... 10-2012-0140009
Jul. 17, 2013 (KR) ..... 10-2013-0084326

(51) Int. Cl.
*F22B 1/28* (2006.01)
*F24H 1/18* (2006.01)

(52) U.S. Cl.
CPC ..... *F22B 1/284* (2013.01)

(58) Field of Classification Search
None
See application file for complete search history.

(56) References Cited

U.S. PATENT DOCUMENTS 3,910,498 A * 10/1975 Harrison ..... B60S 3/00 222/146.5
3,937,184 A * 2/1976 Frei ..... F22B 1/025 122/32

(Continued)

FOREIGN PATENT DOCUMENTS

JP 62-128537 U 8/1987
JP 07-251002 A 10/1995

(Continued)

OTHER PUBLICATIONS

Japanese Office Action, dated Mar. 22, 2016, for Japanese Application No. 2015-546390, 3 pages.

*Primary Examiner* — Thor Campbell
(74) *Attorney, Agent, or Firm* — Seed IP Law Group LLP

(57) ABSTRACT

Provided is a steam generator (1000) which comprises a water tank (200); a heater unit (300) connected with the water tank so as to heat the water; and a spraying unit (500) connected with the heater unit (300), wherein raw water heated by the heater unit (300) is in a high-temperature and high-pressure state in the heater unit (300), and the high-temperature and high-pressure raw water is converted into steam by decompression when sprayed to the outside by the spraying unit (500). The steam generator, according to the present invention, can generate steam without a separate electric power supply device, can generate steam that is harmless to the human body without generating ozone, and can generates an abundant amount of atomized steam through a process for directly heating the supplied raw water by using a heating member disposed in a housing and then secondarily heating the steam of which a phase is primarily changed so as to atomize steam particles, thereby suppressing the ejection of condensed water. In order to suppress rapid boiling which occurs by the overheating of a surface between the heating member and the supplied raw water or (Continued)

an overheated region formed in the housing, and steam explosion in the housing caused thereby, a bubble dispersing member is provided in the heating member, thereby preventing the rapid expansion of the steam. Since the present invention does not require an ozone removing device and an electric power supply device, the size of the steam generator can be reduced and production costs can be lowered, and thus users can easily purchase and use the steam generator at home.

10 Claims, 7 Drawing Sheets

(56) References Cited

U.S. PATENT DOCUMENTS 4,320,702 A * 3/1982 Shein ..... A47J 27/04 122/4 A
RE33,414 E * 10/1990 Morton ..... F24F 6/18 126/113
5,693,267 A * 12/1997 Beshore ..... B01F 3/04021 261/142
5,835,680 A * 11/1998 Glucksman ..... F24H 9/1818 338/315
5,881,207 A * 3/1999 DeBourg ..... F22B 1/285 340/618
6,148,144 A * 11/2000 Milanese ..... A47L 11/34 15/320
6,647,931 B1 * 11/2003 Morgandi ..... F22B 1/285 122/13.3
6,786,182 B2 * 9/2004 Morgandi ..... F22B 1/285 122/4 A
7,103,270 B1 * 9/2006 Chen ..... A47L 11/34 392/386
7,734,158 B2 * 6/2010 Kondo ..... F22B 37/02 392/324
8,365,446 B2 * 2/2013 Ng ..... D06F 75/12 219/248
8,369,695 B2 * 2/2013 Lee ..... F24C 15/327 392/386
8,615,166 B2 * 12/2013 Kim ..... D06F 39/008 392/394
9,702,544 B2 * 7/2017 Amoretti ..... F22B 1/28
2005/0051531 A1 * 3/2005 Shozo ..... F24C 15/327 219/401
2005/0051532 A1 * 3/2005 Shozo ..... A21B 3/04 219/401
2005/0056634 A1 * 3/2005 Shozo ..... F24C 14/005 219/401
2009/0290858 A1 * 11/2009 Altman ..... A61H 33/065 392/485
2011/0088199 A1 * 4/2011 Chung ..... A47L 11/34 15/320
2012/0060396 A1 * 3/2012 Collinson ..... D06F 75/12 38/77.6

FOREIGN PATENT DOCUMENTS

JP 09-079503 A 3/1997
JP 2011-067725 A 4/2011
KR 1020080065134 A 7/2008
KR 1020090061857 A 6/2009
KR 1020090080780 A 7/2009

* cited by examiner

[FIG. 1]
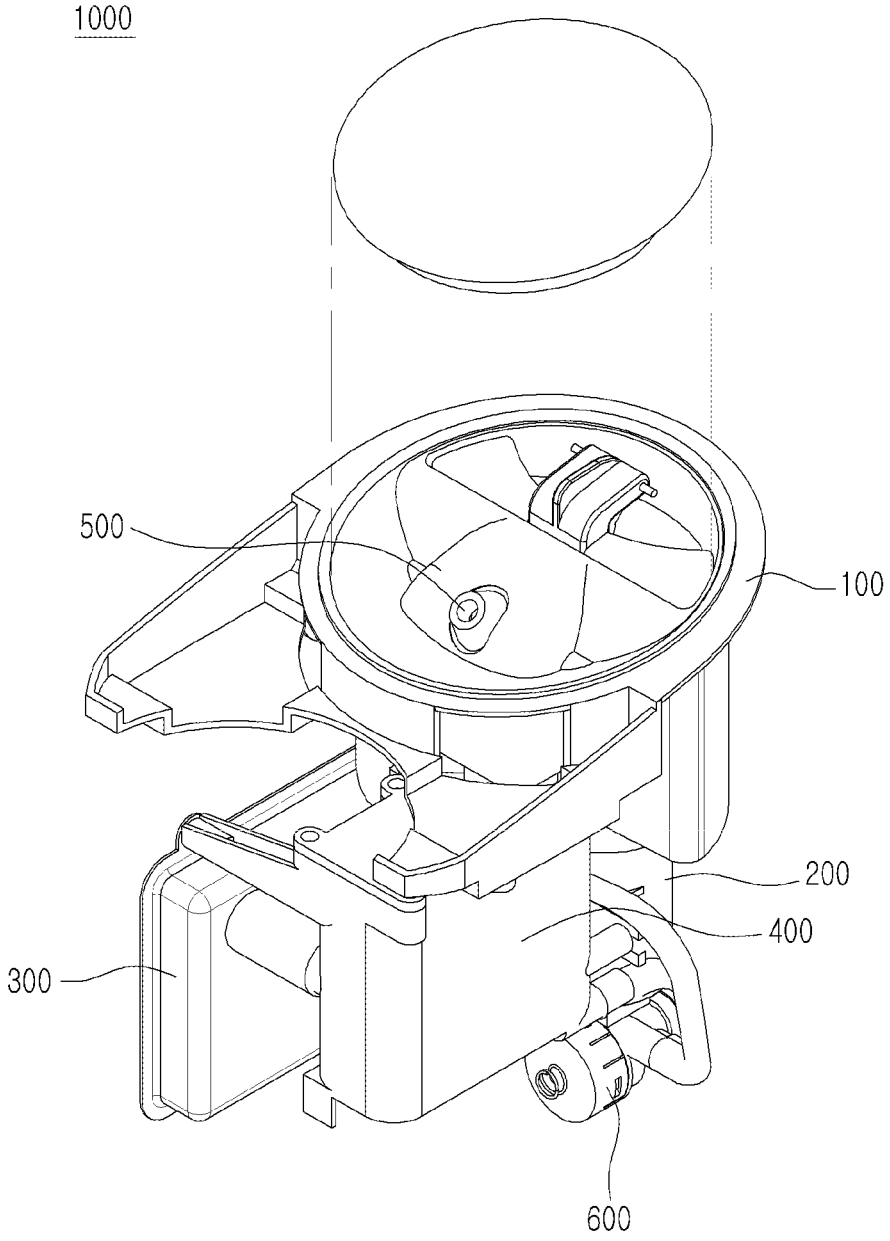

[FIG. 2]
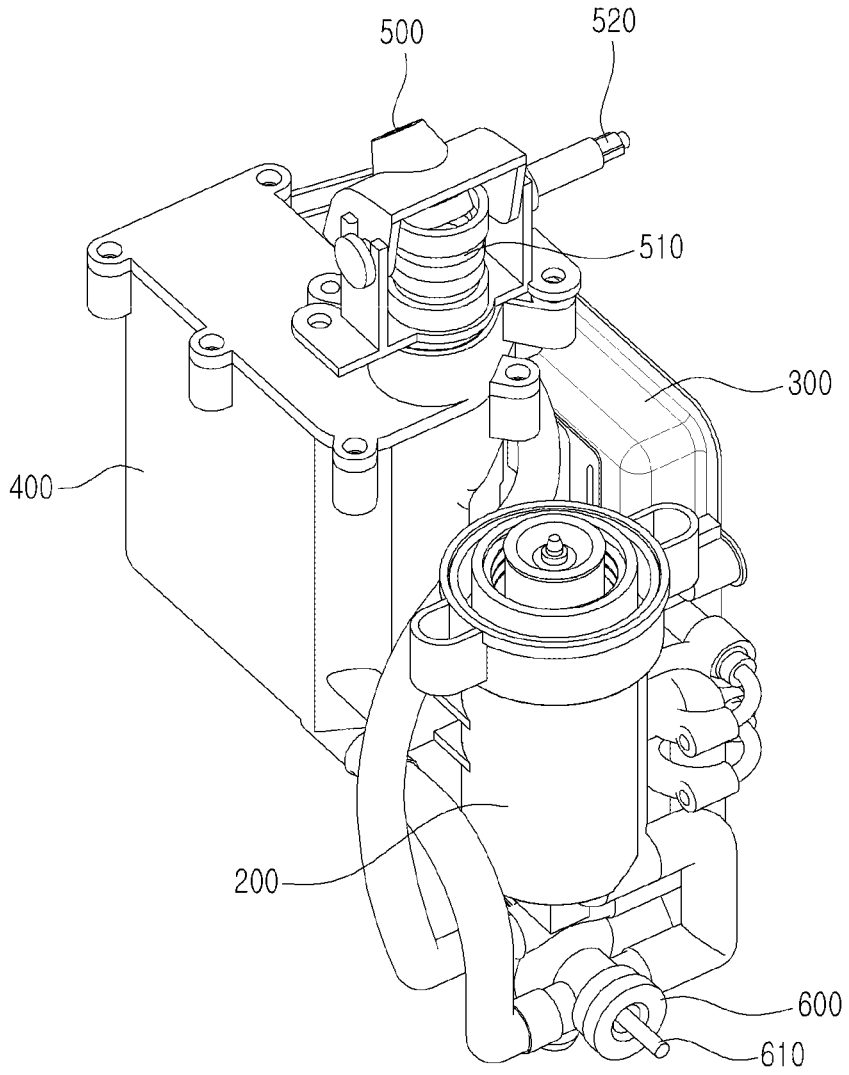

[FIG. 3]
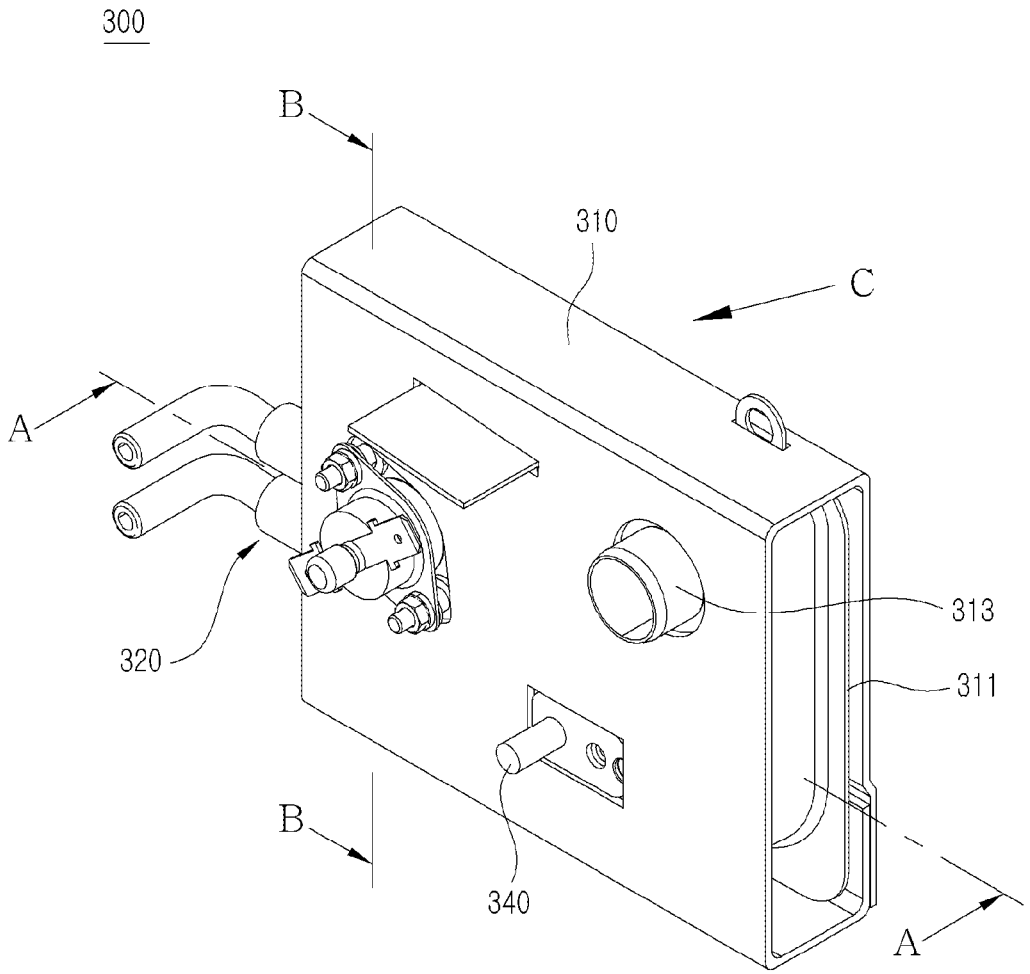

[FIG. 4]
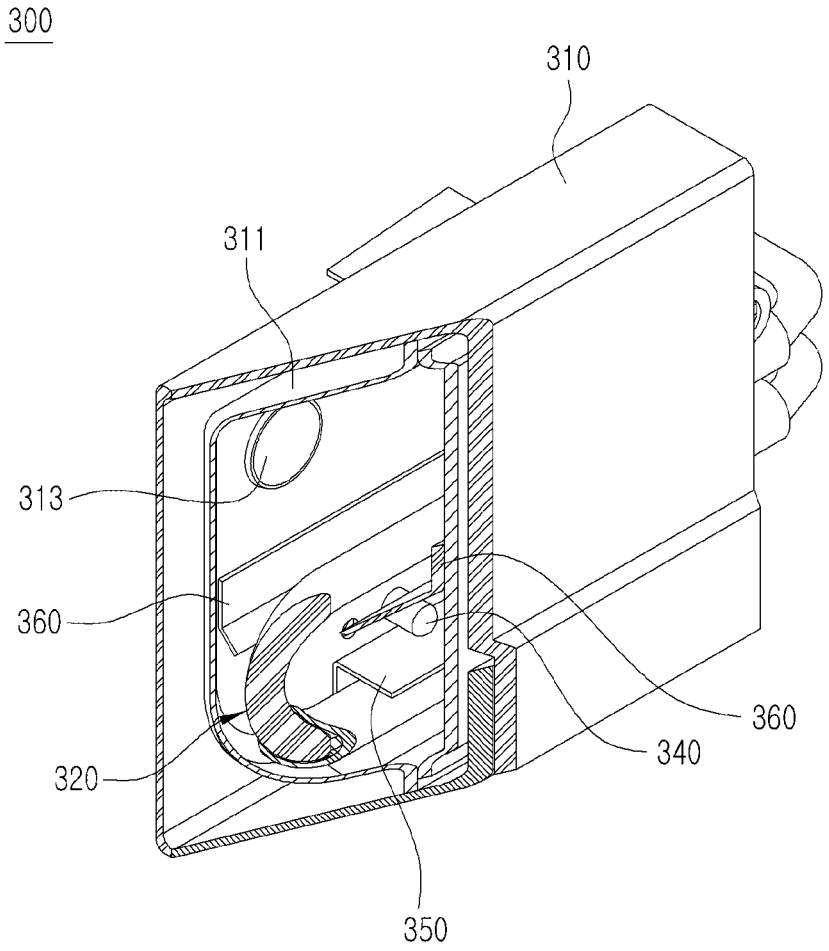

[FIG. 5]
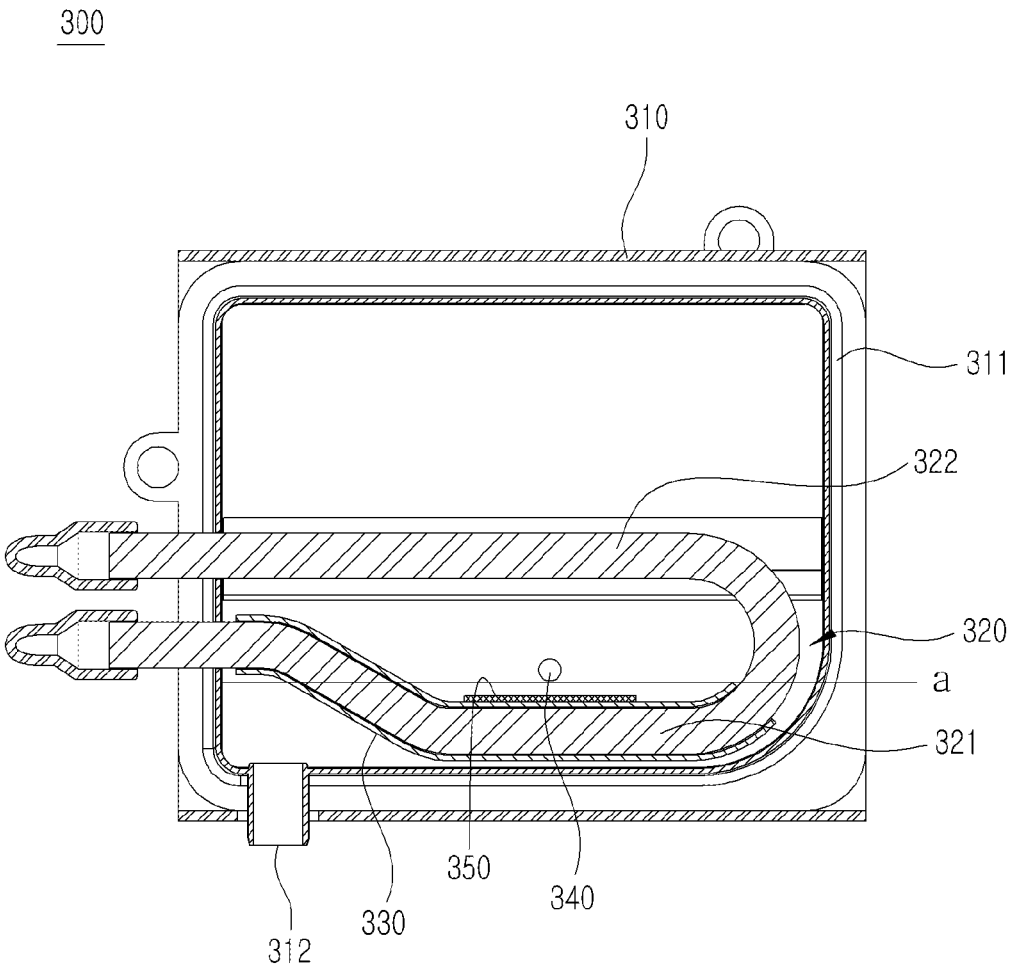

[FIG. 6]
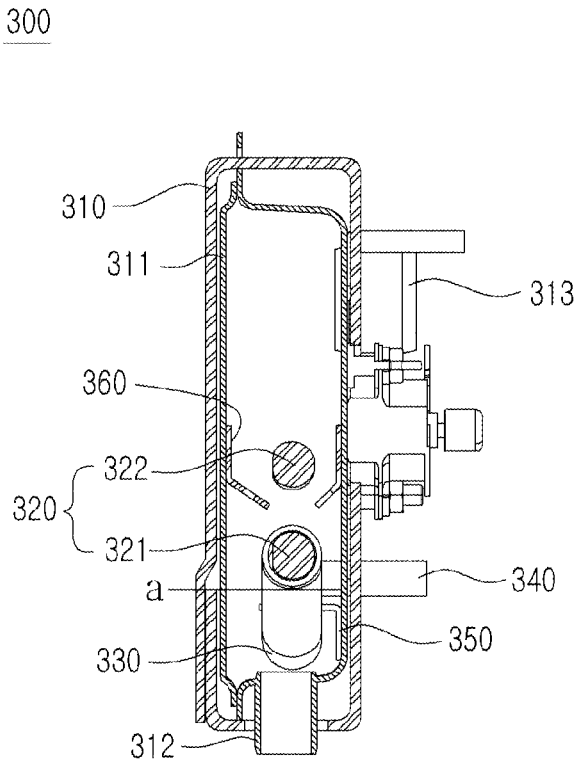

[FIG. 7]
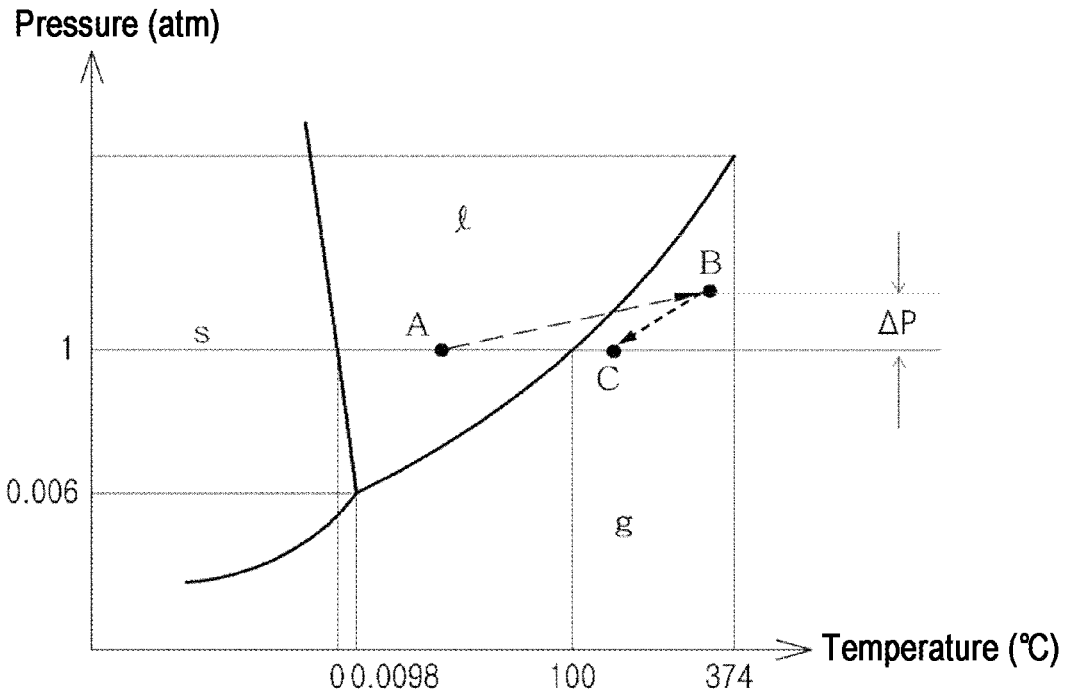

STEAM GENERATOR

TECHNICAL FIELD

The present invention relates to a steam generator using a decompression method, and more specifically, to a steam generator using a principle of continuously heating heated raw water into high-temperature and high-pressure state, while secondarily heating the supplied raw water to prevent formation of overheated region in the heating process and subsequent generation of a strong steam such as bumping, thus enabling stable atomization of the raw water, in which steam is generated due to decompression when the raw water is exposed to lower pressure and lower temperature.

BACKGROUND ART

Recently, steams have various applications in areas including cleaning, humidification, cooking and aesthetic management. In particular, when sprayed onto skin, steam can remove wastes in the pores of the skin or old keratin cells. Accordingly, a steam supplying device is widely used not only in skin care clinics such as dermatology or skin care shops, but also at homes.

A conventional steam generator generally employs an electrostatic atomization method. A steam generator employing the electrostatic atomization method includes a reservoir in which water is stored, and a discharge electrode and an opposite electrode positioned in the reservoir. The steam generator atomizes the liquid in the vicinity to the discharge electrode, by applying high voltage to the discharge electrode. The atomized liquid, which is so-called 'steam', is supplied to a user.

Such atomization-type steam generator has a limit in its compactness due to need for separate electrodes.

Further, in a steam generator that atomizes water by applying high voltage, in addition to the steam, ozone is generated and ejected. As the linkage between the high ozone concentration and adverse effect to human health have already been well known through a plurality of researches, issues have arisen regarding safety and reliability of the device.

This steam generator employing electrostatic atomization method has no choice but to be separately equipped with a device to reduce ozone concentration, which in turn causes large-sized device and increased production cost. There is another shortcoming that the device consumes a considerable amount of power.

Accordingly, a method of generating steams by heating raw water can be used. However, this heating-type steam generator has unstable overheated regions in the process of heating the raw water introduced into a housing, and these overheated regions cause the raw water existing in the housing to be pushed up.

As described, the ascending raw water along sidewalls inside the housing undergoes instant gasification when contacted with the sidewalls that are heated to high temperature, resulting in rapid rise of the pressure inside the housing and release of strong steam (i.e., bumping) outside the housing.

Meanwhile, an example of a method to enable stable operation of a steam oven employing a steam generator is disclosed in Korean Patent Application Publication No. 10-2008-0065134 (KR 2008-0065134). This document provides a water level sensor to stably sense variations in water level, and a steam generator having the same, and a cooking device having the steam generator, and proposes that the water level sensor having one electrode is installed on a steam receptacle that stores water necessary for steam generation to stably sense the variations in the water level, irrespective of whether or not scale is generated.

In the above document, installing the water level sensor can enable stable operation of the steam generator. However, the document does not specifically describe how the issues of the gas explosion caused due to the abrupt gasification of the supplied raw water and pressure rise are addressed. Accordingly, the issues of stability and reliability of the device described above remain to be studied further.

(Patent Document 1) JP 2011-67725 A (Patent Document 2) KR 2008-0065134 A

DISCLOSURE OF INVENTION

Technical Problem

Accordingly, an objective of the present invention is to provide a steam generator which can be compact-sized using decompression principle, and which can generate steams that are harmless to human health.

Further, another objective of the present invention is to provide a steam generator which provides a stable atomization by secondarily heating supplied raw water and steam to prevent strong steam which would otherwise be formed due to formation of overheated regions in the process of heating the supplied raw water.

Solution to Problem

In view of the objectives described above, a steam generator 1000 according to the present invention includes a water tank 200, a heater unit 300 connected with the water tank 200 so as to heat water, and a spraying unit 500 connected with the heater unit 300, in which raw water heated by the heater unit 300 is in a high-temperature and high-pressure state in the heater unit 300, and upon being sprayed to outside by the spraying unit 500, the high-temperature and high-pressure raw water is converted into steam by decompression.

Preferably, the heater unit 300 includes a hollow case 310 including a raw water inlet 312 disposed at a lower portion, and a steam outlet 313 disposed at an upper portion, and a heating member 320 supplying heat to the raw water and a steam within the case 310, in which the heating member 320 performs a first heating of the raw water introduced into the case 310 through the raw water inlet 312, and a second heating in which atomization of the high-temperature and high-pressure raw water in which has been produced by the first heating.

Preferably, the heating member 320 includes an in-water heating unit 321 submerged in the raw water inside the case 310, and an in-steam heating unit 322 disposed above the raw water and in the high-temperature and high-pressure raw water.

Preferably, the heater unit 300 additionally includes a bubble dispersion member 330 disposed to surround the in-water heating unit 321.

Preferably, the bubble dispersion member 330 is in a coil shape.

Preferably, the heater unit 300 additionally includes a temperature sensor 340 sensing a temperature inside the case 310, and a sensor shielding unit 350 disposed between the temperature sensor 340 and the in-water heating unit 321.

Preferably, the heater unit 300 additionally includes a partition 360 disposed along an inner wall of the housing 100 toward an upper side of the in-water heating unit 321, and the partition 360 formed to be inclined toward an interior of the housing 100, in a direction toward a lower portion.

Preferably, the temperature sensor 340 measures the temperature inside the case 310 in real-time basis, and stops operation of the heating member 320, when the temperature inside the case 310 exceeds a preset temperature value.

Preferably, the temperature sensor 340 senses a water level inside the case 310 based on the temperature measured in the case 310.

Preferably, the steam generator 1000 additionally includes a rectifying tank 400 connected with the heater unit 300, the high-temperature and high-pressure raw water in the heater unit 300 is converted into steam by decompression in the rectifying tank 400, and the steam is sprayed outside by the spraying unit 500.

Preferably, the steam generator 1000 additionally includes a direction shifting unit 520 provided on one side of the spraying unit 500 to change a direction of the steam discharged from the spraying unit 500.

Advantageous Effects of Invention

As described above, the steam generator according to the present invention can generate steam without a separate electric power supply device, can generate steam that is harmless to the human body without generating ozone, and can generate an abundant amount of atomized steam through a process for directly heating the supplied raw water using a heating member disposed in a housing and then secondarily heating the high-temperature and high-pressure raw water is primarily changed so as to atomize steam particles, thereby suppressing the ejection of condensed water.

Further, in order to suppress rapid boiling which occurs by the overheating of a surface between the heating member and the supplied raw water or an overheated region formed in the housing, and steam explosion in the housing caused thereby, a bubble dispersing member is provided in the heating member, thereby preventing the rapid expansion of the steam.

Furthermore, since the present invention does not require an ozone removing device and an electric power supply device, the size of the steam generator can be reduced and production costs can be lowered, and thus users can easily purchase and use the steam generator at home.

BRIEF DESCRIPTION OF DRAWINGS

The above and/or other aspects and advantages of the present invention will become apparent and more readily appreciated from the following detailed description, taken in conjunction with the accompanying drawings of which:

FIG. 1 is a perspective view of a steam generator according to an embodiment of the present invention;

FIG. 2 is an exploded perspective view of a steam generator according to an embodiment of the present invention;

FIG. 3 is a perspective view of a heater unit, which is one of constituent components of a steam generator according to an embodiment of the present invention;

FIG. 4 is a partially-cut perspective view of FIG. 3, seen from a direction C;

FIG. 5 is a cross-sectional view taken on line A-A of FIG. 3;

FIG. 6 is a cross-sectional view taken on line B-B of FIG. 3; and

FIG. 7 is a water phase diagram.

MODE FOR CARRYING OUT THE INVENTION

The constituent components of a steam generator 1000 of the present invention may be integrally formed or separately formed and used, depending on needs. Further, depending on a configuration in use, certain components may be omitted.

The embodiments of the steam generator 1000 will be explained in greater detail below with reference to the drawings attached hereto. Lines or components may be illustrated in the drawings in exaggerated thickness or sizes for the purpose of clarity and convenience of explanation. Further, the terms described below are defined in consideration of the functions in the present invention, and may be varied depending on the intention of a user or an operator. Therefore, the definitions of these terms should be described based on the overall description.

1. Description of Components of Steam Generator 1000

Hereinbelow, the components of the steam generator 1000 according to an embodiment of the present invention will be explained with reference to FIGS. 1 to 6.

As illustrated in FIG. 1, the steam generator 1000 includes a housing 100, a water tank 200, a heater unit 300, a rectifying tank 400 and a spraying unit 500, and supplies the steam. In one embodiment, the steam may be used for the purpose of aesthetic management for a user, among a variety of applications.

The housing 100, which is an outer case of the steam generator 1000, has the components of the steam generator 1000 positioned in the housing 100.

The water tank 200 is positioned inside the housing 100 and stores the water supplied by the user. The user may directly supply the water to the water tank 200, or depending on embodiments, a separate tank may be provided, with which the user may supply the water.

Hereinbelow, the heater unit 300, which is one of the main components of the steam generator 1000 according to the present invention, will be explained with reference to FIGS. 3 to 6.

The heater unit 300 includes a hollow case 310, a heating member 320 supplying heat toward the raw water and steam inside the case 310, a temperature sensor 340 sensing temperature inside the case 310, a bubble dispersion member 330 disposed so as to surround the heating member 320, a sensor shielding unit 350 disposed between the temperature sensor 340 and the heating member 320, and a partition 360 disposed to be inclined toward the interior of the case 310, in a direction toward a lower portion along an inner wall of the case 310. The case 310 includes a raw water inlet 312 formed on a lower portion thereof, and a steam outlet 313 formed on an upper portion thereof.

The heating member 320 includes an in-water heating unit 321 submerged in the raw water inside the case 310, and an in-steam heating unit 322 disposed in the high-temperature and high-pressure raw water above the raw water.

For example, the heating member 320 may be a member that generates heat in an electrical manner, while being connected to an external heat source (not illustrated) of the case 310.

Further, for example, the heating member 320 may be in '⊏' shape as illustrated in FIG. 5, although this is provided merely for an exemplary illustration, and the shape of the heating member 320 is not limited to any specific example.

The in-steam heating unit 322 of the heating member 320 is disposed inside the case 310, and in the space above the raw water. The in-steam heating unit 322 adjusts the steam particles into increased density, by the process of re-providing the heat to the high-temperature and high-pressure raw water evaporated from the raw water.

That is, the heating member 320 performs a first heating of the raw water that enters the case 310 from the water tank 200 through the raw water inlet 312, and a second heating in which atomization of the high-temperature and high-pressure raw water which has been produced by the first heating.

In the heating member 320, the in-steam heating unit 321 performs a function of transmitting the heat to the raw water while being in direct contact with the raw water. In a specific example, the bubble dispersion member 330 is disposed so as to directly surround the in-water heating unit 321. For example, the bubble dispersion member 330 is in coil-like configuration which is coupled in a manner of being wound around the in-water heating unit 321.

As described, the bubble dispersion member 330 coupled with the in-water heating unit 321 disperses the bubbles generated from the raw water as the heat from the in-water heating unit 321 is transmitted to the raw water. That is, the bubbles generated in the process of raw water boiling are adjusted to a smaller size due to the bubble dispersion member 330.

The temperature sensor 340 is disposed in the case 310, and between the in-water heating unit 321 and the in-steam heating unit 322. In the present invention, the temperature sensor 340 measures in real-time the temperature inside the case 310, and the water level of the raw water is sensed based on the measured temperature. Specifically, when the raw water inside the case 310 maintains a reference state or below, the measured temperature will be exceeding a preset temperature value, in which case the operation may be stopped by way of cutting off the electricity supply to the heating member 320.

That is, the temperature sensor 340 performs two roles: a first role for sensing water level of the raw water; and a second role as a safety device which stops steam generation when the real-time temperature measurements indicate extremely high temperature.

The sensor shielding unit 350 is disposed between the temperature sensor 340 and the in-water heating unit 321. In the process that the raw water introduced into the case 310 is heated, bubbles generated may abruptly move toward the temperature sensor 340, thus influencing the result of temperature measurements. Accordingly, the above can be prevented by the sensor shielding unit 350 which shields the upper portion of the in-water heating unit 321.

The partition 360 is disposed along the inner wall of the case 310, toward the upper portion of the in-water heating unit 321. Specifically, the partition 360 is inclined to the interior of the case 310, toward a direction of the lower portion. Such an arrangement of the partition 360 blocks the abrupt flow of steam that rises along the inner wall of the case 310 due to sudden boiling caused from the overheated regions formed by the heating member 320 in the case 310.

The heater unit 300 additionally includes an inner frame 311 disposed in the case 310, and a separate insulating member (not illustrated) may be disposed between the case 310 and the inner frame 311. The inner frame 311 is fixed on the inner wall of the case 310, and the partition 360 and the raw water inlet 312 are fixed.

The insulating member minimizes heat transmission from the heated steam inside the case 310 to outside, so that heat efficiency of the heating member 320 is maximized.

The rectifying tank 400 is connected to the heater unit 300, and the high-temperature and high-pressure raw water heated at the heater unit 300 is discharged through the steam outlet 313, flowed along a connection passage, and introduced into the rectifying tank 400. As the heated, high-temperature and high-pressure raw water enters the rectifying tank 400, the high-temperature and high-pressure raw water is converted into steam due to lowered ambient atmospheric pressure and temperature. This will be explained in greater detail below when explaining operation.

Additionally, depending on embodiments, the rectifying tank 400 may be omitted, in which case the heater unit 300 is connected with the spraying unit 500.

The spraying unit 500 sprays the generated steam outside the steam generator 1000, using any manner that is appropriate to do so. The spraying unit 500 is preferably positioned outside the housing 100 to more efficiently supply the steam to the user, and in one embodiment, the spraying unit 500 may be positioned on an upper side of the housing 100, as illustrated in FIG. 1.

Further, referring to FIG. 2, the spraying unit 500 may be connected with a supply hose 152 and supplied with the steam, and the direction of discharging the steam may be varied by manipulating a direction shifting unit 520 provided on one side of the spraying unit 500.

2. Description of Operation of Steam Generator 1000

Hereinbelow, the operation of the steam generator 1000 according to the present invention will be explained.

First, the user may fill the water tank 200 with water or, for example, the user may supply the raw water to the steam generator 1000 through a separate tank. The supplied raw water is passed through the passage connected to the water tank 200 and introduced into the heater unit 300 through the raw water inlet 312.

The situation regarding the raw water supply inside the case 310 is then checked, through the temperature sensor 340.

At this time, the amount of raw water entering the heater unit 300 is related with how much heat is absorbed from the heat applied by the heater unit 300. This is one of important variables with which the raw water introduced into the heater unit 300 is converted to high-temperature and high-pressure state. Accordingly, it is preferable that a proper amount of raw water is introduced into the heater unit 300 to be heated.

Further, the heating member 320 included in the heater unit 300 may be in a '⊏ ' shape, for example.

In the above example, the raw water may be filled in the lower side of the '⊏ '-shaped heating member, or more specifically, the raw water fills only a portion of the lower side of the '⊏ '-shaped heating member.

That is, the amount of the introduced raw water is so adjusted that only the in-water heating unit 321 at the lower side is submerged in the raw water. Referring to FIGS. 5 and 4, the reference water level for the raw water may be set to line 'a' which is set at the lower end of the temperature sensor 340, for example.

After that, when the raw water level inside the case 310 reaches the reference state, electricity is supplied to the heating member 320, thus performing the first heating through the in-water heating unit 321. The heating continues even when the introduced raw water exceeds 100° C. at which point the raw water is in high-temperature and high-pressure state. Referring to FIG. 7, the introduced raw water is converted from state A into state B and the high-temperature and high-pressure raw water fills the upper side of the '⊏ '-shaped heating member, i.e., fills the in-steam heating unit 322 side.

Next, the second heating is performed at the in-steam heating unit 322, in which atomization phenomenon occurs with the high-temperature and high-pressure raw water which has been heated in the first heating.

In the heating process by the heating member 320, the sensor shielding unit 350 enables accurate measurement at the temperature sensor 340, while the partition 360 concurrently prevents bumping phenomenon, which is the generation of strong steam due to sudden temperature rise of the raw water.

Next, the high-temperature and high-pressure raw water stored in the heater unit 300 is discharged through the steam outlet 313 and flowed through the connection passage to the rectifying tank 400. When the raw water enters the rectifying tank 400, due to significantly lower temperature and pressure in the rectifying tank 400 than the temperature and pressure inside the heater unit 300, steam is generated from the raw water by decompression. Referring to FIG. 7, as the high-temperature and high-pressure raw water (state B in FIG. 7) is introduced into the rectifying tank 400, the raw water undergoes gasification (state C in FIG. 7), generating steam.

The generated steam is flowed through the supply passage connected to the rectifying tank 400 and ejected outside the steam generator 1000 through the spraying unit 500. The direction of the discharged steam may be adjusted to a position or a direction as desired by the user, through adjustment with the direction shifting unit.

Further, in one embodiment of the present invention, the rectifying tank 400 may be omitted, in which case the raw water in high-temperature, high pressure state in the heater unit 300 may be flowed to a spray port. The raw water flowed and discharged through the spray port generates steam upon exposure to the atmospheric pressure, as described above. After the device is used, remaining raw water may be discharged through a drain valve 600 connected to the water tank 200 and the spray port. A drain valve button 610 may be used, as illustrated in FIG. 2.

Because the steam generator 1000 using decompression method described above does not require use of separate electrodes or ozone removing device, the device can be compact-sized and generate steam that is harmless to human health.

Further, it is possible to generate an abundant amount of atomized steam through a process for directly heating the supplied raw water and then secondarily heating the high-temperature and high-pressure raw water is primarily changed so as to further reduce the size of the steam particles, thereby suppressing the ejection of condensed water.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

The invention claimed is:

1. A steam generator, comprising:

a water tank;

a heater unit connected with the water tank, the heater unit in operation, heating water in the water tank; and a spraying unit connected with the heater unit, the spraying unit in operation, spraying water heated by the heater unit, the heater unit comprises:

a hollow case comprising a raw water inlet and a steam outlet; and a heating member, which in operation, heats raw water introduced into the hollow case to produce high-temperature and high-pressure raw water, wherein the heating member performs a first heating of the raw water introduced into the hollow case through the raw water inlet to produce the high-temperature and high-pressure raw water and performs a second heating to atomize the high-temperature and high-pressure raw water which is produced by the first heating, wherein atomized high-temperature and high-pressure raw water is converted into steam by decompression upon being sprayed outside by the spraying unit.

2. The steam generator of claim 1, wherein the heating member comprises:

an in-water heating unit submerged in the raw water inside the hollow case; and an in-steam heating unit disposed above the raw water and in the high-temperature and high-pressure raw water.

3. The steam generator of claim 2, wherein the heater unit further comprises a bubble dispersion member disposed so as to surround the in-water heating unit.

4. The steam generator of claim 3, wherein the bubble dispersion member is in a coil shape.

5. The steam generator of claim 2, wherein the heater unit further comprises:

a temperature sensor sensing a temperature inside the case; and a sensor shielding unit disposed between the temperature sensor and the in-water heating unit.

6. The steam generator of claim 2, wherein the heater unit further comprises a partition disposed along an inner wall of the housing toward an upper side of the in-water heating unit, and the partition is formed to be inclined toward an interior of the housing, in a direction toward a lower portion.

7. The steam generator of claim 5, wherein the temperature sensor measures the temperature inside the case in real-time basis, and stops operation of the heating member, when the temperature inside the case exceeds a preset temperature value.

8. The steam generator of claim 5, wherein the temperature sensor senses a water level inside the case based on the temperature measured in the case.

9. The steam generator of claim 1, wherein the steam generator further comprises a rectifying tank connected with the heater unit, the atomized high-temperature and high-pressure raw water in the heater unit is converted into steam by decompression in the rectifying tank, and the steam is sprayed outside by the spraying unit.

10. The steam generator of claim 9, wherein the steam generator further comprises a direction shifting unit provided on one side of the spraying unit to change a direction of the steam discharged from the spraying unit.

* * * * *